US006133537A

United States Patent [19]

Onodera et al.

[11] Patent Number: 6,133,537

[45] Date of Patent: Oct. 17, 2000

[54] ELECTRIC CONTACT STRUCTURE AS WELL AS RELAY AND SWITCH USING THE SAME

[75] Inventors: Tokiichi Onodera; Matsujirou Ikeda, both of Tokyo, Japan

[73] Assignee: NEC Corporation, Tokyo, Japan

[21] Appl. No.: 09/533,672

[22] Filed: Mar. 23, 2000

[30] Foreign Application Priority Data

Mar. 29, 1999 [JP] Japan ..... 11-085750

[51] Int. Cl.[7] ..... H01B 1/02; H01H 1/02

[52] U.S. Cl. ..... 200/266; 252/514; 428/457; 200/268; 200/269

[58] Field of Search ..... 252/514; 200/502, 200/238, 266, 268, 269; 439/907, 387; 420/508, 511; 428/457

[56] References Cited

U.S. PATENT DOCUMENTS 4,069,370 1/1978 Harmsen et al. ..... 428/671
4,111,690 9/1978 Harmsen ..... 75/165
4,339,644 7/1982 Aldinger et al. ..... 200/266
4,980,245 12/1990 Marino ..... 428/671

FOREIGN PATENT DOCUMENTS

06325650 A1 11/1994 Japan .
06108181 4/1999 Japan .

*Primary Examiner*—Mark Kopec
*Attorney, Agent, or Firm*—Young & Thompson

[57] ABSTRACT

The present invention provides an electric contact structure comprising a first contact surface and a second contact surface, wherein at least one of the first and second contact surfaces comprises an AuAgPd alloy including 7–16% by weight of Ag and 1–10% by weight of Pd, whereby a high anti-adhesion property and a highly stable contact resistance can be obtained particularly when the electric contacts are in non-operating state.

18 Claims, 6 Drawing Sheets

ELECTRIC CONTACT STRUCTURE AS WELL AS RELAY AND SWITCH USING THE SAME

BACKGROUND OF THE INVENTION

The present invention relates to an improved electric contact structure as well as a relay and a switch which use the same, and more particularly to a small-size relay and a small-size switch operable with a relatively small current for communication devices.

In recent years, the requirements for scaling down electric or electronic devices and possible reductions in power consumption thereof have been on the increase. In this circumstances, the requirement for scaling down a relay or a switch to be mounted on a printed board for a communication device and also for improvement in sensitivity thereof have also been on the increase. The small-size relay or switch needs a small contact force or a small contact pressure. It is particularly important to keep a stability of an initial contact resistance. To keep the stability of the initial contact resistance, it is preferable that a contact surface layer is made of a soft metal.

The relay and switch are placed in a part such as a cover made of a plastic material, whereby the contact surface layer is exposed to an organic gas atmosphere. The relay and switch may receive an external load. The material for the contact surface layer is required to have a stable surface state in order to ensure a good contact resistance under various conditions.

It has been known in the art to which the present invention pertains that Au and an AuAg alloy are soft and stable in surface state as well as show a high conductivity. Au and AuAg are so soft as showing a plastic deformation. This plastic deformation may cause a possible adhesion of the contact surface with an opposite contact surface. The adhesion of the contact surface with the opposite contact surface may cause the loss of reliability.

A development of the contact surface layer material having an anti-adhesion property has been made. In Japanese laid-open patent publication No. 6-108181, it is disclosed that 1–10% by weight of Pd and 10–100 ppm of C are added to Au or the AuAg alloy to prepare the contact surface layer material, so that the electric contact superior in anti-adhesion property and contact stability is obtained.

In Japanese laid-open patent publication No. 6-325650, it is disclosed that an AuNi alloy, an AuPd alloy or an AuAgPt alloy is used for contact surface layers of confronting contacts in order to obtain an anti-adhesion property and a contact stability.

The adhesion between the soft metal contact surface layers of the contacts may be caused both in operating state of the electric contacts and in receipt of external shock or vibration during non-operating state. The above Japanese publication addresses that the anti-adhesion property is improved but only in operating state. The above soft metal materials have a problem that upon receipt of external vibration or external shock in non-operating state or upon application of vibration due to ultrasonic cutter, an adhesion of a break contact, which is in contact with a counterpart contact surface in closed-state, may be caused, whereby it is difficult to enter the contact into opening state, wherein the break contact is separated from the counterpart contact surface whilst a make contact is in contact with another counterpart contact surface. A probability of appearance of adhesion of the contact surfaces is increased as a content of Au in the contact surface layer is high. It is effective to reduce the content of Au in the contact surface layer for improvement in the anti-adhesion property. This reduction in reduce the content of Au causes another problem with reducing the stability of the contact resistance. Consequently, it is difficult for the above conventional technique to obtain both the high anti-adhesion property and the highly stable contact resistance.

Furtber, if the alloy of the contact surface layer includes Ni, still another problem is caused in a segregation of Ni, whereby it is difficult to obtain a stability of the contact resistance.

In the above circumstances, it had been required to develop a novel electric contact surface structure free from the above problem.

SUMMARY OF THE INVENTION

Accordingly, it is an object of the present invention to provide a novel electric contact surface structure free from the above problems.

It is a further object of the present invention to provide a novel electric contact surface structure which allows a high anti-adhesion property and a highly stable contact resistance particularly when electric contacts remain in contact with each other in closed state.

It is a still further object of the present invention to provide a novel relay using the electric contact surface structure free from the above problems.

It is yet a further object of the present invention to provide a novel relay using the electric contact surface structure which allows a high anti-adhesion property and a highly stable contact resistance particularly when electric contacts remain in contact with each other in closed state.

It is still more object of the present invention to provide a novel switch using the electric contact surface structure free from the above problems.

It is yet more object of the present invention to provide a novel switch using the electric contact surface structure which allows a high anti-adhesion property and a highly stable contact resistance particularly when electric contacts remain in contact with each other in closed state.

The present invention provides an electric contact structure comprising a first contact surface and a second contact surface, wherein at least one of the first and second contact surfaces comprises an AuAgPd alloy including 7–16% by weight of Ag and 1–10% by weight of Pd, whereby a high anti-adhesion property and a highly stable contact resistance can be obtained particularly when the electric contacts are in non-operating state.

The above and other objects, features and advantages of the resent invention will be apparent from the following descriptions.

BRIEF DESCRIPTION OF THE DRAWINGS

Preferred embodiments according to the present invention will be described in detail with reference to the accompanying drawings.

DISCLOSURE OF THE INVENTION

Figure 1:
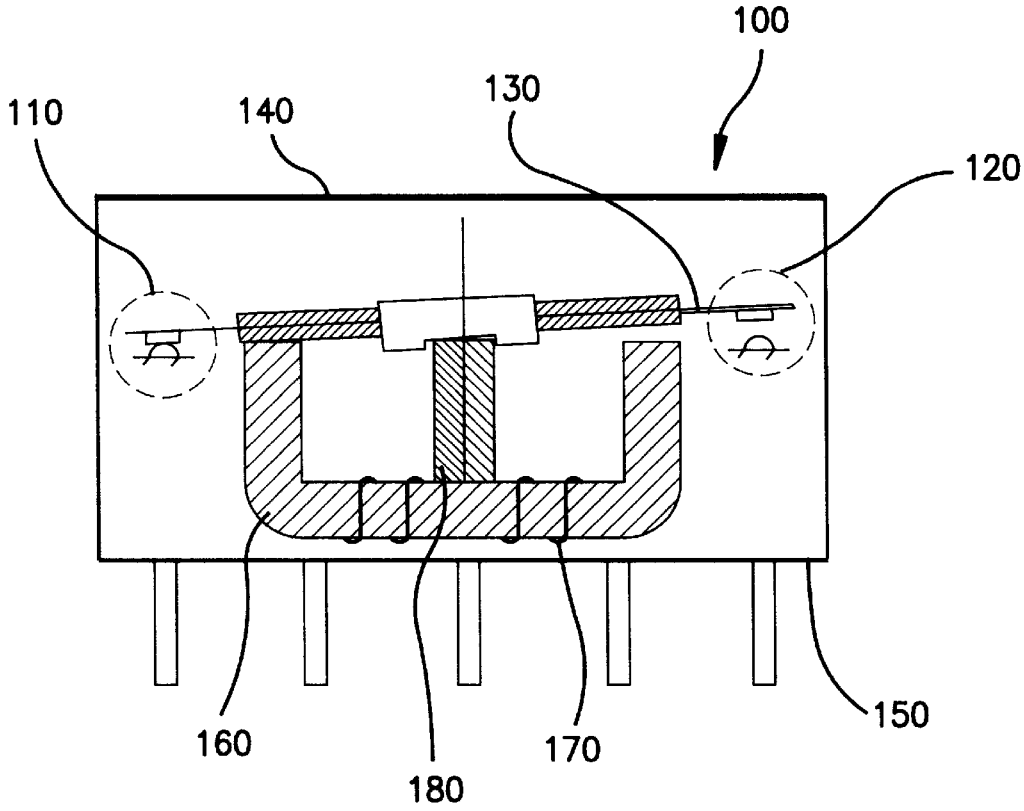
FIG. 1 is a schematic view illustrative of a structure of a relay using a novel electric contact structure in accordance with the present invention.

The present invention provides an electric contact structure comprising a first contact surface and a second contact surface, wherein at least one of the first and second contact surfaces comprises an AuAgPd alloy including 7–16% by weight of Ag and 1–10% by weight of Pd, whereby a high anti-adhesion property and a highly stable contact resistance can be obtained particularly when the electric contacts are in non-operating state.

It is possible that remaining one of the first and second contact surfaces comprises Au, whereby a high anti-adhesion property and a highly stable contact resistance can be obtained particularly when the electric contacts are in non-operating state. Alternatively it is also possible that remaining one of the first and second contact surfaces comprises an AuAg alloy, whereby a high anti-adhesion property and a highly stable contact resistance can be obtained particularly when the electric contacts are in non-operating state.

It is preferable that a total compositional ratio of Ag and Pd is not less than 14% by weight, whereby a high anti-adhesion property and a highly stable contact resistance can be obtained particularly when the electric contacts are in non-operating state. It is possible that remaining one of the first and second contact surfaces comprises Au. Alternatively, it is also possible that remaining one of the first and second contact surfaces comprises an AuAg alloy.

It is possible that at least one of the first and second contact surfaces is formed on an intermediate alloy layer jointed with a contact spring member, so that the intermediate alloy layer is effective to compensate an influence to a contact resistance characteristic due to generated pin holes or friction of the contact surface layer by frequent operations of the electrical contacts, whereby the compensation results in long life-time and high reliability. In this case, it is preferable the intermediate alloy layer comprises an AgNi alloy, so that the intermediate alloy layer is effective to compensate an influence to a contact resistance characteristic due to generated pin holes or friction of the contact surface layer by frequent operations of the electrical contacts, whereby the compensation results in long life-time and high reliability. Alternatively, it is preferable that the intermediate alloy layer comprises an AgPd alloy, so that the intermediate alloy layer is effective to compensate an influence to a contact resistance characteristic due to generated pin holes or friction of the contact surface layer by frequent operations of the electrical contacts, whereby the compensation results in long life-time and high reliability.

It is possible that at least one of the first and second contact surfaces is formed on an intermediate alloy layer formed on a base metal layer jointed with a contact spring member, whereby it is easy to joint the intermediate alloy layer and the contact surface to the contact spring and also a joint strength is improved. In this case, it is possible that the intermediate alloy layer comprises an AgNi alloy, so that the intermediate alloy layer is effective to compensate an influence to a contact resistance characteristic due to generated pin holes or friction of the contact surface layer by frequent operations of the electrical contacts, whereby the compensation results in long life-time and high reliability. Alternatively, it is possible that the intermediate alloy layer comprises an AgPd alloy, so that the intermediate alloy layer is effective to compensate an influence to a contact resistance characteristic due to generated pin holes or friction of the contact surface layer by frequent operations of the electrical contacts, whereby the compensation results in long life-time and high reliability. It is further preferable that the base metal layer comprises a CuNi alloy, whereby it is easy to joint the intermediate alloy layer and the contact surface to the contact spring and also a joint strength is improved.

The above novel electric contact structure may be applied to a relay and a switch.

The novel contact surface of the AuAgPd alloy is superior in anti-adhesion property in non-operating state than the conventional contact surface of the AuPdC alloy. The combination of AuAgPd alloy of the contact surface layer with the specific alloy of the intermediate metal layer underlying the contact surface layer improves the property of the contact.

It is important that at least one of the first and second contact surface layers is made of the AuAgPd alloy. The contact of Au in the contact surface layer provides a large effect to the anti-adhesion property and the contact resistance. If the contact of Ag is excessively low, for example, not more than 5% by weight, then the contact of the soft metal Au is high in relation to the low content of Ag, whereby the hardness of the alloy is low, and the anti-adhesion property is not good. In order to improve the anti-adhesion property, it is effective to increase the content of Pd. If, however, the content of Pd is excessively high, then it is possible that an organic substance on the contact surface is changed to form an insulator so called to as brown-power, resulting in imperfect contact. If the content of Ag is excessively large, for example, not less than 20% by weight, it is difficult to suppress formation of sulfide. It was found by the present inventors that a preferable range in content of Ag is 7–16% by weight.

If the content of Pd is excessively low, the hardness of the AuAgPd alloy is made closer to the hardness of the AuAg, whereby the anti-adhesion property is not good. If, however, the content of Pd is excessively high, then the above problem with the imperfect contact due to generation of insulator. It was confirmed by the present inventor that a preferable range in content of Pd is 1–10% by weight. Since the AuAgPd alloy is exposed to an air, a solid solution of Pd and C existing in the air is caused, whereby 10 ppm of C is contained in the AuAgPd alloy as an impurity.

A total amount in content of Ag and Pd provides a large efficiency to the anti-adhesion property and the stable contact resistance. It was confirmed by the present inventors that a preferable range in total amount of Ag and Pd is not less than 14% by weight in order to obtain a desirable anti-adhesion property.

The relay or the switch has two contacts, for example, a make contact and a break contact. In an initial state, the make contact is in open-state where the make contact is separated from a counterpart make contact surface, whilst the break contact is in close-state where the break contact is in contact with a counterpart break contact surface.

In the initial state, a contact surface of the make contact is exposed to an organic gas atmosphere. Generally, one of the make contact and the counterpart make contact is a fixed contact and the remaining one is a movable contact. A contact surface layer of at least one of the make contact and the counterpart make contact comprises the AuAgPd alloy, whilst a contact surface layer of the remaining one of the make contact and the counterpart make contact comprises Au or the AuAg alloy.

In the initial state, a contact surface of the break contact remains in contact with the counterpart break contact surface whereby the contact surface is not exposed to the organic gas atmosphere. However, the break contact is likely to receive an external vibration or external shock, whereby it is likely that the break contact is adhered with the counterpart break contact. In order to avoid this problem with the adhesion, a hard metal or a hard alloy is effective to ensure an anti-adhesion property. The hard metal or hard alloy is, however, disadvantages in low stability of the contact resistance. In accordance with the present inventions however, the AuAgPd alloy is used for the contact surface layers of the break contact and the counterpart break contact in order to obtain both the high anti-adhesion property and the high stability of the contact resistance. Particularly, the AuAgPd alloy is greatly effective to prevent the adhesion due to external vibration and external shock in the non-operational state.

The surface contact layer is formed on the intermediate metal layer which is jointed with the contact spring. The intermediate metal layer does not provide a direct contribution to the improvements in the anti-adhesion property and the contact stability in the non-operational state. The intermediate metal layer is effective to compensate an influence to a contact resistance characteristic due to generated pin holes or friction of the contact surface layer by frequent operations of the electrical contacts, whereby the compensation results in long life-time and high reliability. The material or alloy for the intermediate alloy layer is selected under electrical load and combination with the alloy of the contact surface layer. If the electrical load is low, then an AgNi alloy is preferable for the intermediate alloy layer. Otherwise, the AgPd alloy is preferable for the intermediate alloy layer.

Further, the base metal layer may be provided between the intermediate metal layer and the contact spring in order to increase the joint strength to the contact spring. The material for the base metal layer is selected to allow the base metal layer to be welded to the contact spring material such as phosphorous bronze. For example, the CuNi alloy is preferable.

Figure 2:
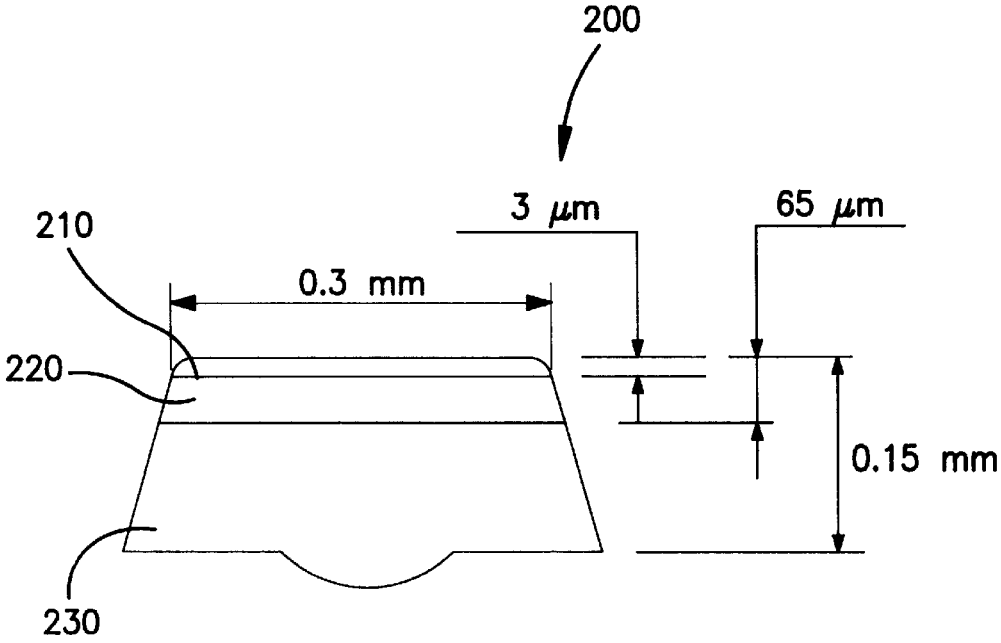
FIG. 2 is a cross sectional elevation view illustrative of a contact tape structure used in a relay of FIG. 1.

In the following examples 1–5 and comparative examples 1–5, a relay 100 illustrated in FIG. 1 was formed. The relay 100 comprises a bottom sealing 150, an iron-core 160, a coil 170, a magnet 180, a cover 140, contact plate-spring members 130 and break movable and fixed contacts 110 and make movable and fixed contacts 120. The structure of the relay 100 is the same as already known. The relay 100 is a micro-signal relay of non-latch and sealed type having a polar structure. The movable contacts are twin contacts, where a contact force is about 5 gr and a contact gap is 0.3 mm. The contact is a contact tape 200 having a sectional structure as shown in FIG. 2. Namely, the contact tape 200 has a three-layered structure comprises a base metal layer 230, an intermediate layer 220 on the base metal layer 230, and a contact surface layer 210 on the intermediate metal layer 220. The base metal layer 230 is bonded with a contact spring and a terminal by a resistance-welding method. The base metal layer 230 comprises a CuNi alloy. The intermediate metal layer 220 comprises an $Ag_{40}Pd_{60}$ alloy. The contact surface layer 210 comprises different materials for every examples and every comparative examples. The contact surface layer 210 has a width of 0.3 mm and a thickness of 3 micrometers. A total thickness of the contact surface layer 210 and the intermediate metal layer 220 is 65 micrometers. A total thickness of of the contact surface layer 210, the intermediate metal layer 220 and the base metal layer 230 is 0.15 mm. The above descriptions of the structure of the relay illustrated in FIG. 1 and the contact structure illustrated in FIG. 2 are common to the following examples 1–5 and comparative examples 1–5.

EXAMPLE 1

In this example, the break movable contact has a break movable contact surface layer which comprises an alloy of $Au_{82}Ag_{15}Pd_3$, whilst the break fixed contact has a break fixed contact surface layer which comprises the same alloy of $Au_{82}Ag_{15}Pd_3$. The alloy $Au_{82}Ag_{15}Pd_3$ has a compositional ratio of 82% by weight of Au, 15% by weight of Ag and 3% by weight of Pd.

EXAMPLE 2

In this example, the break movable contact has a break movable contact surface layer which comprises an alloy of $Au_{76}Ag_{15}Pd_9$, whilst the break fixed contact has a break fixed contact surface layer which comprises the same alloy of $Au_{76}Ag_{15}Pd_9$. The alloy $Au_{76}Ag_{15}Pd_9$ has a compositional ratio of 76% by weight of Au, 15% by weight of Ag and 9% by weight of Pd.

EXAMPLE 3

In this example, the break movable contact has a break movable contact surface layer which comprises an alloy of $Au_{86}Ag_8Pd_6$, whilst the break fixed contact has a break fixed contact surface layer which comprises the alloy of $Au_{86}Ag_8Pd_6$. The alloy $Au_{86}Ag_8Pd_6$ has a compositional ratio of 86% by weight of Au, 8% by weight of Ag and 6% by weight of Pd.

EXAMPLE 4

In this example, the break movable contact has a break movable contact surface layer which comprises an alloy of $Au_{86}Ag_8Pd_6$, whilst the break fixed contact has a break fixed contact surface layer which comprises Au. The alloy $Au_{86}Ag_8Pd_6$ has a compositional ratio of 86% by weight of Au, 8% by weight of Ag and 6% by weight of Pd.

EXAMPLE 5

In this example, the break movable contact has a break movable contact surface layer which comprises an alloy of $Au_{86}Ag_8Pd_6$, whilst the break fixed contact has a break fixed contact surface layer which comprises the alloy of $Au_{92}Ag_8$. The alloy $Au_{86}Ag_8Pd_6$ has a compositional ratio of 86% by weight of Au, 8% by weight of Ag and 6% by weight of Pd. The alloy $Au_{92}Ag_8$ has a compositional ratio of 92% by weight of Au and 8% by weight of Ag.

COMPARATIVE EXAMPLE 1

In this comparative example, the break movable contact has a break movable contact surface layer which comprises an alloy of $Au_{92}Ag_8$, whilst the break fixed contact has a break fixed contact surface layer which comprises the alloy of $Au_{92}Ag_8$. The alloy $Au_{92}Ag_8$ has a compositional ratio of 92% by weight of Au and 8% by weight of Ag.

COMPARATIVE EXAMPLE 2

In this comparative example, the break movable contact has a break movable contact surface layer which comprises an alloy of $Au_{75}Ag_{25}$, whilst the break fixed contact has a break fixed contact surface layer which comprises the alloy of $Au_{92}Ag_8$. The alloy $Au_{75}Ag_{25}$ has a compositional ratio of 75% by weight of Au and 25% by weight of Ag. The alloy $Au_{92}Ag_8$ has a compositional ratio of 92% by weight of Au and 8% by weight of Ag.

COMPARATIVE EXAMPLE 3

In this comparative example, the break movable contact has a break movable contact surface layer which comprises an alloy of $Au_{85}Ag_{15}$, whilst the break fixed contact has a break fixed contact surface layer which comprises the alloy of $Au_{85}Ag_{15}$. The alloy $AU_{85}Ag_{15}$ has a compositional ratio of 85% by weight of Au and 15% by weight of Ag.

COMPARATIVE EXAMPLE 4

In this comparative example, the break movable contact has a break movable contact surface layer which comprises an alloy of $Au_{75}Ag_{25}$, whilst the break fixed contact has a break fixed contact surface layer which comprises the alloy of $Au_{75}Ag_{25}$. The alloy $Au_{75}Ag_{25}$ has a compositional ratio of 75% by weight of Au and 25% by weight of Ag.

COMPARATIVE EXAMPLE 5

In this comparative example, the break movable contact has a break movable contact surface layer which comprises an alloy of $Au_{90}Ag_5Pd_5$, whilst the break fixed contact has a break fixed contact surface layer which comprises the alloy of $Au_{90}Ag_5Pd_5$. The alloy $Au_{90}Ag_5Pd_5$ has a compositional ratio of 90% by weight of Au, 5% by weight of Ag and 5% by weight of Pd.

TABLE 1

| | movable contact | fixed contact | adhesion | contact resistance |
|---|---|---|---|---|
| Ex. 1 | $Au_{82}Ag_{15}Pd_3$ | $Au_{82}Ag_{15}Pd_3$ | good | good |
| Ex. 2 | $Au_{76}Ag_{15}Pd_9$ | $Au_{76}Ag_{15}Pd_9$ | very good | good |
| Ex. 3 | $Au_{86}Ag_8Pd_6$ | $Au_{86}Ag_8Pd_6$ | good | good |
| Ex. 4 | $Au_{86}Ag_8Pd_6$ | Au | good | good |
| Ex. 5 | $Au_{86}Ag_8Pd_6$ | $Au_{92}Ag_8$ | good | good |
| Co. 1 | $Au_{92}Ag_8$ | $Au_{92}Ag_8$ | very bad | good |
| Co. 2 | $Au_{72}Ag_{25}$ | $Au_{92}Ag_8$ | bad | good |
| Co. 3 | $Au_{85}Ag_{15}$ | $Au_{85}Ag_{15}$ | bad | very bad |
| Co. 4 | $Au_{75}Ag_{25}$ | $Au_{75}Ag_{25}$ | very good | very bad |
| Co. 5 | $Au_{90}Ag_5Pd_5$ | $Au_{90}Ag_5Pd_5$ | bad | good |

Figure 3:
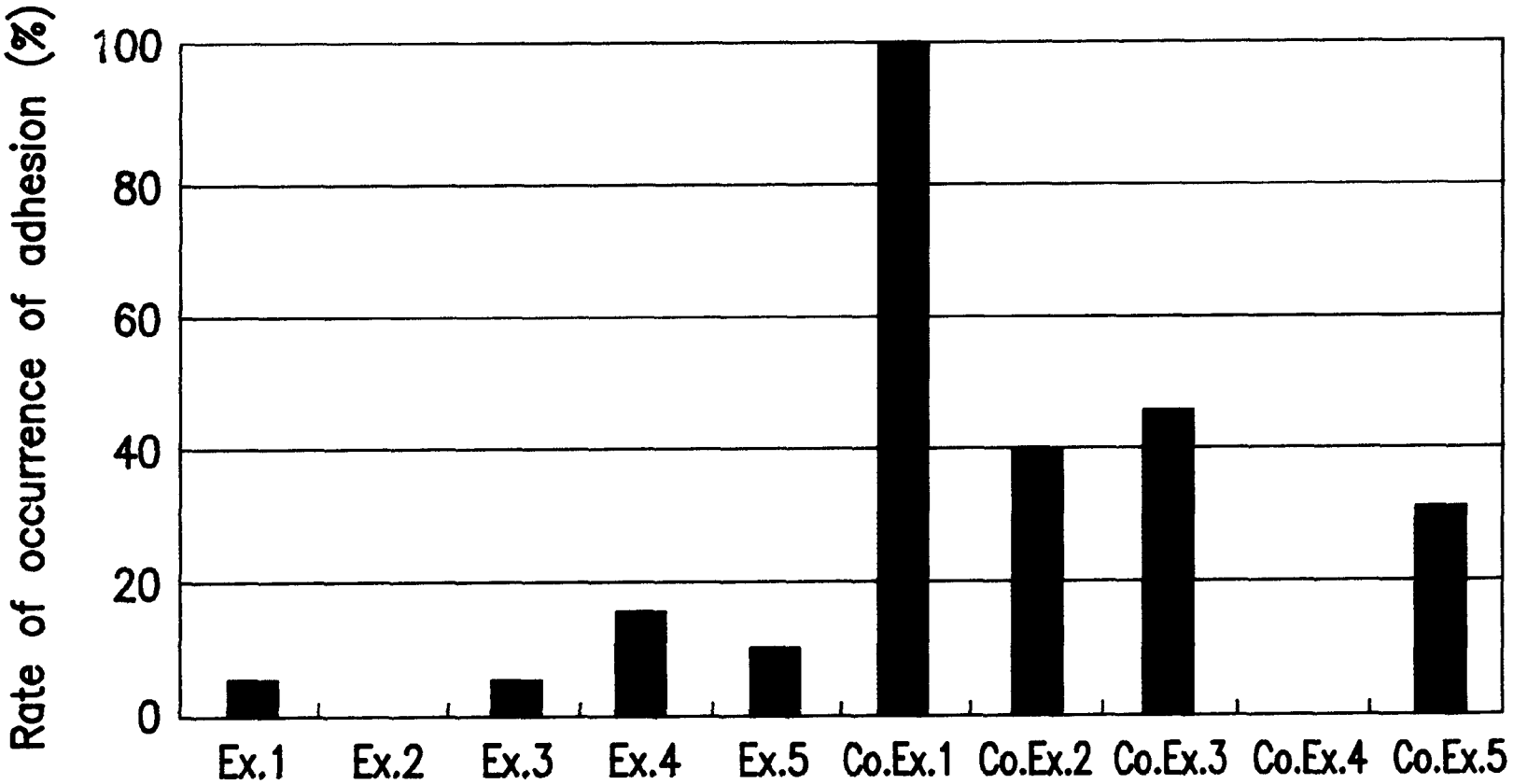
FIG. 3 is a graph showing individual rates of occurrence of the adhesion for every examples 1–5 and comparative examples 1–5.

(1) Evaluations on Anti-Adhesion Property (A) evaluation on anti-adhesion property versus external shock in non-operational state;

In each of the above examples 1–5 and the above comparative examples 1–5, 20 relays having the individual contacts were examined in anti-adhesion property to the external shock in the non-operational state. The relay was inserted into a cylindrically shaped magazine of 550 mm in length. Stoppers were capped to opposite ends of the cylindrically shaped magazine. A self-weight drop of the relay in a vertical direction was carried out three times before it was confirmed whether or not an adhesion between the contacts appears to find a rate of occurrence of the adhesion. FIG. 3 is a graph showing individual rates of occurrence of the adhesion for every examples 1–5 and comparative examples 1–5. In comparative example 1, the rate of occurrence of the adhesion was 100%. In comparative example 2, the rate of occurrence of the adhesion was 40%. In comparative example 3, the rate of occurrence of the adhesion was over 40%. In comparative example 4, the rate of occurrence of the adhesion was 0%. In comparative example 5, the rate of occurrence of the adhesion was 30%. In example 1, the rate of occurrence of the adhesion was 5%. In example 2, the rate of occurrence of the adhesion was 0%. In example 3, the rate of occurrence of the adhesion was 5%. In example 4, the rate of occurrence of the adhesion was 15%. In example 5, the rate of occurrence of the adhesion was 10%. In examples 1–5 and comparative example 4, the rates of occurrence of the adhesion were low. In comparative examples 1–3 and 5, the rates of occurrence of the adhesion were high.

Figure 4:
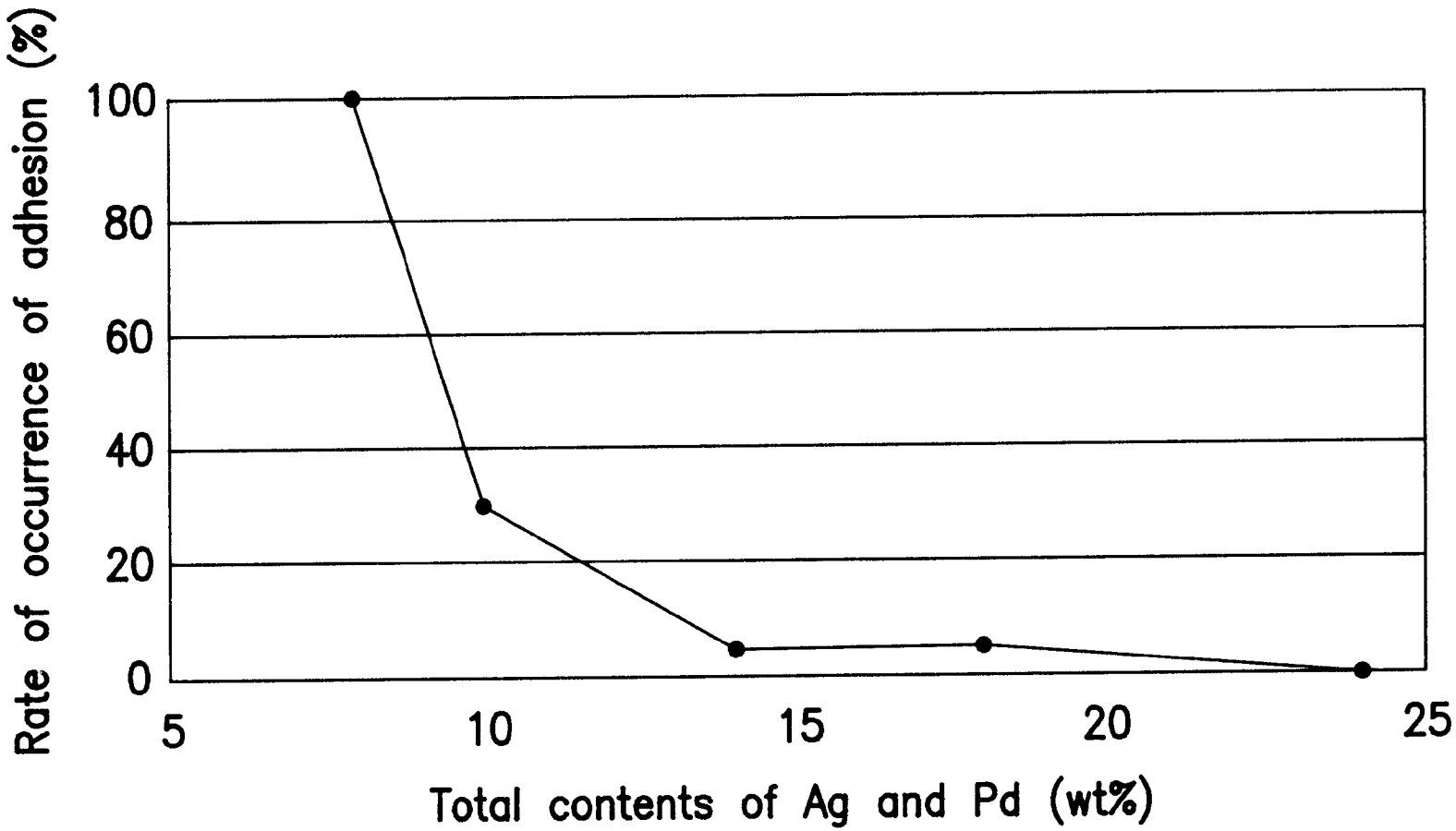
FIG. 4 is a diagram illustrative of variation of rate of occurrence of adhesion versus a total contact of Ag and Pd from the examination results of examples 1–5 and comparative examples 1 and 5.

FIG. 4 is a diagram illustrative of variation of rate of occurrence of adhesion versus a total contact of Ag and Pd from the examination results of examples 1–5 and comparative examples 1 and 5. If the total contact of Ag and Pd is not less than 14% by weight, then the rate of occurrence of adhesion is low.

(B) evaluation on anti-adhesion property in operational state;

In each of the above examples 1–5 and the above comparative examples 1–5, 20 relays having the individual contacts were examined in anti-adhesion property in the operational state. In each of the above examples 1–5 and the above comparative examples 1–5, the rate of occurrence of adhesion is low.

Figure 5:
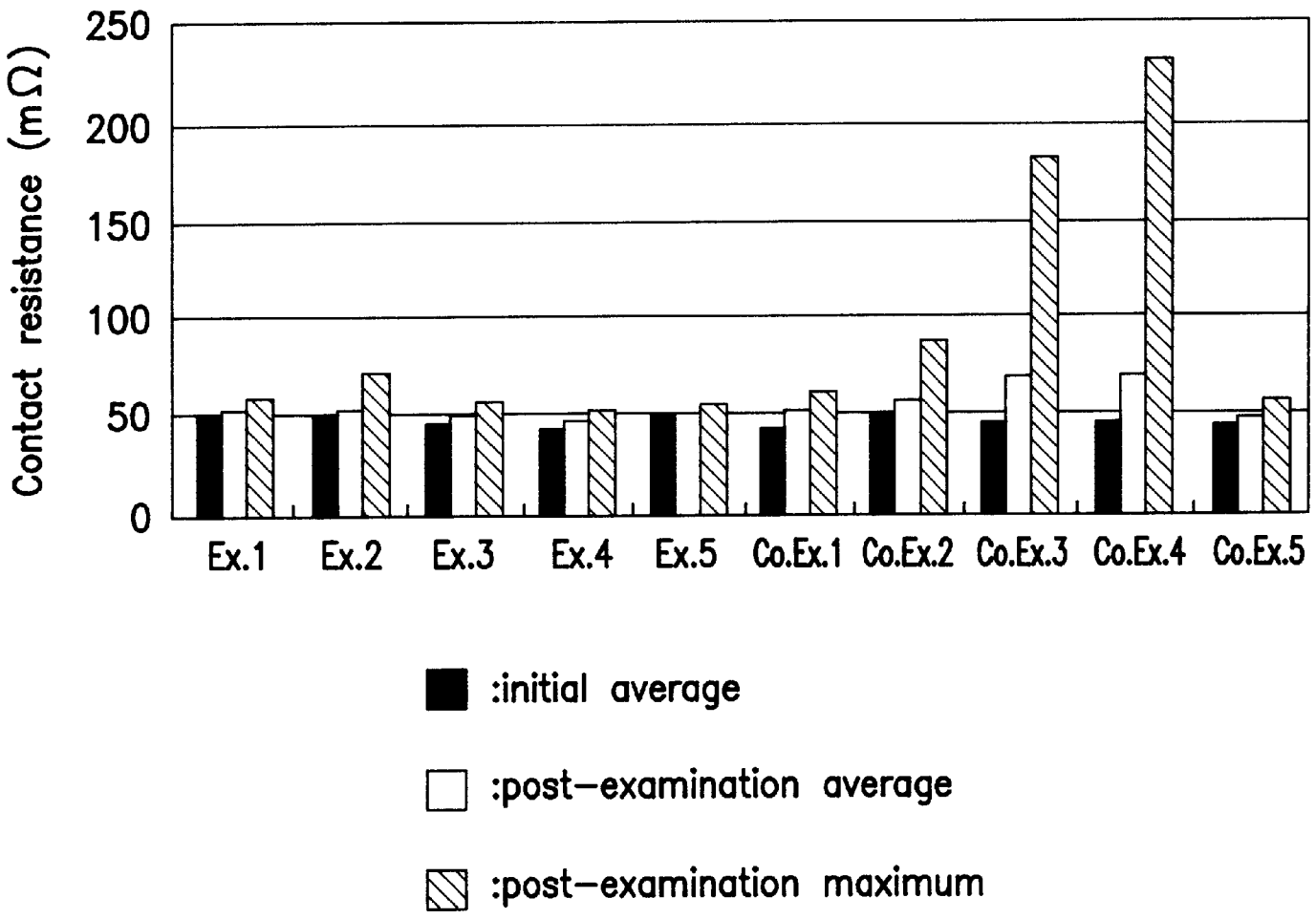
FIG. 5 is a graph showing contact resistances in initial average value, post-examination average value and post-examination maximum value of 20 relays in each of the above examples 1–5 and the above comparative examples 1–5.

(2) Evaluation on Stability of Contact Resistance (A) mechanical traveling test under high temperature circumstances;

In each of the above examples 1–5 and the above comparative examples 1–5, 20 relays having the individual contacts were examined by 10000000 times of opening/closing operations under no load at 10Hz and 50 duty and at a temperature of 70° C., thereby confirming variation in contact resistance. FIG. 5 is a graph showing contact resistances in initial average value, post-examination average value and post-examination maximum value of 20 relays in each of the above examples 1–5 and the above comparative examples 1–5. In examples 1–5, and comparative examples 1, 2 and 5, differences of the contact resistance between the initial average values and the post-examination average values are small and variations of the contact resistances are also small. In comparative examples 3 and 4, differences of the contact resistance between the initial average values and the post-examination average values are large and variations of the contact resistances are also very large. The contacts in comparative examples 3 and 4 are poor in reliability.

Figure 6:
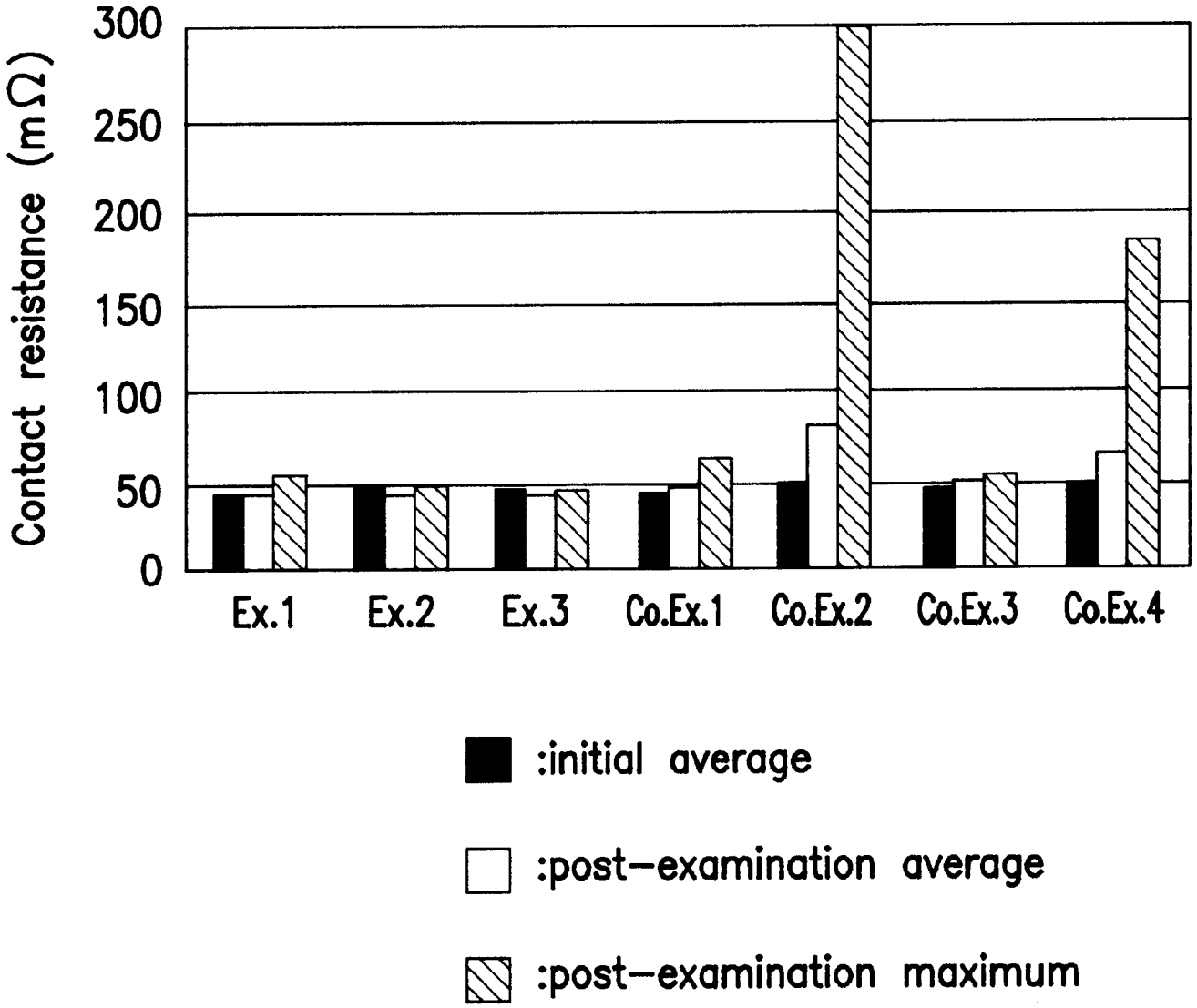
FIG. 6 is a graph showing contact resistances in initial average value, post-examination average value and post-examination maximum value of 20 relays in each of the above examples 1–3 and the above comparative examples 1–4.

(B) mechanical traveling test under normal temperature circumstances;

In each of the above examples 1–3 and the above comparative examples 1–4, 20 relays having the individual contacts were examined by 20000000 times of opening/closing operations under no load at 10Hz and 50 duty and at a temperature of 25° C., thereby confirming variation in contact resistance. FIG. 6 is a graph showing contact resistances in initial average value, post-examination average value and post-examination maximum value of 20 relays in each of the above examples 1–3 and the above comparative examples 1–4. In examples 1–3, and comparative examples 1 and 3, differences of the contact resistance between the initial average values and the post-examination average values are small and variations of the contact resistances are also small. In comparative examples 2 and 4, differences of the contact resistance between the initial average values and the post-examination average values are large and variations of the contact resistances are also very large. The contacts in comparative examples 2 and 4 are poor in reliability.

Figure 7:
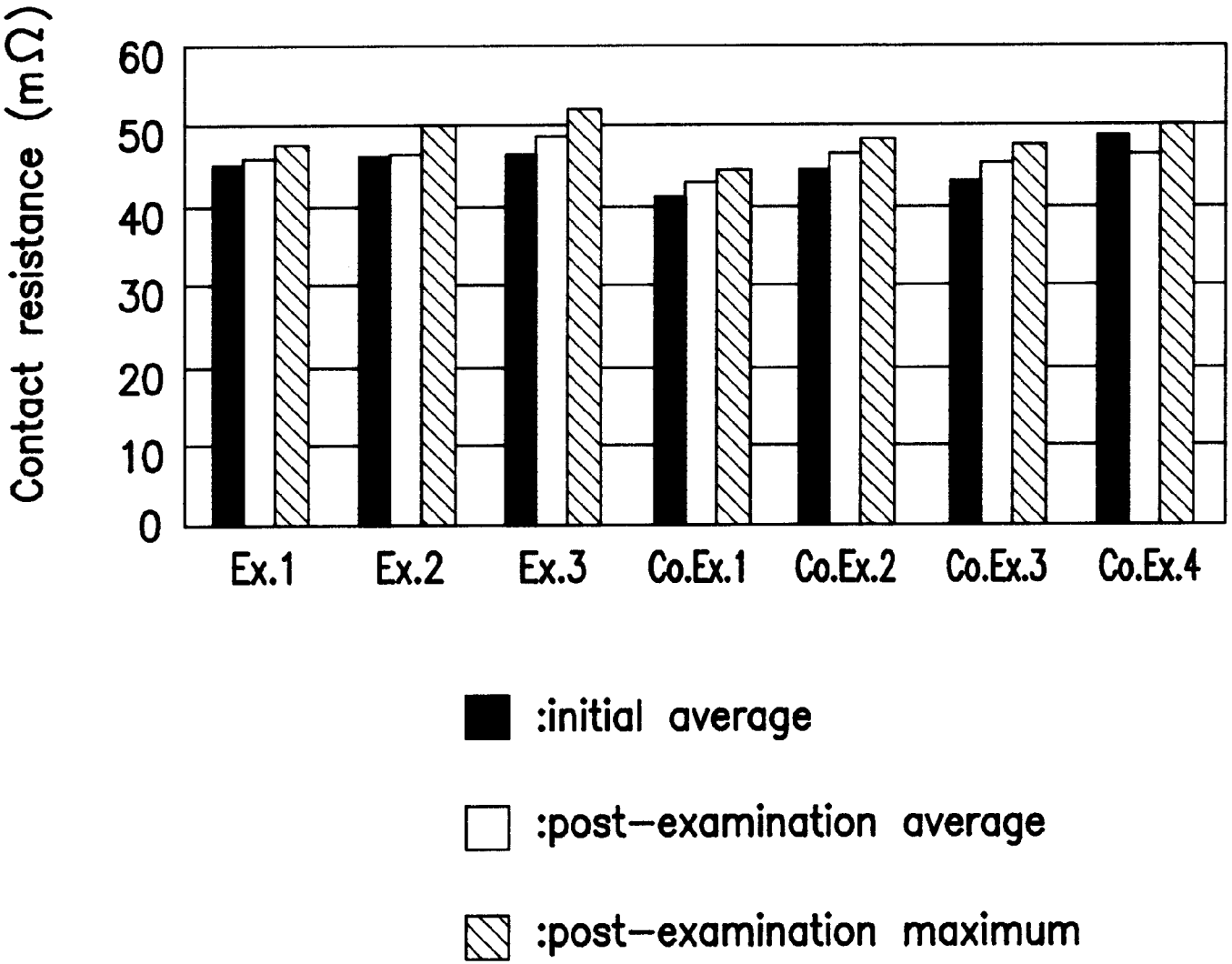
FIG. 7 is a graph showing contact resistances in initial average value, post-examination average value and post-examination maximum value of 20 relays in each of the above examples 1–3 and the above comparative examples 1–4.

(C) evaluation on stability under high temperature circumstances;

In each of the above examples 1–3 and the above comparative examples 1–4, 20 relays having the individual contacts were placed under no load at a temperature of 85° C. for 800 hours, thereby confirming variation in contact resistance. FIG. 7 is a graph showing contact resistances in initial average value, post-examination average value and post-examination maximum value of 20 relays in each of the above examples 1–3 and the above comparative examples 1–4. In examples 1–3, and comparative examples 1–4, differences of the contact resistance between the initial average values and the post-examination average values are small and variations of the contact resistances are also small.

Consequently, from the above examples and comparative examples, it can be understood that it is difficult for AuAg alloy to obtain both the anti-adhesion property and the stability of the contact resistance. If the AuAgPd alloy with an Ag content of less than 7% by weight is used, then the anti-adhesion property and the stability of the contact resistance are superior but only in the operational state. However, the anti-adhesion property to the external shock in the non-operational state is poor. If the AuAgPd alloy with an Ag content in the range of 7–16% by weight is used, there are obtained not only the good anti-adhesion property in the operational state but also the good anti-adhesion property and the high stability of the contact resistance in the non-operational state.

Whereas modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims all modifications which fall within the spirit and scope of the present invention.

What is claimed is:

1. An electric contact structure comprising a first contact surface and a second contact surface, wherein at least one of said first and second contact surfaces comprises an AuAgPd alloy including 7–16% by weight of Ag and 1–10% by weight of Pd.

2. The electric contact structure as claimed in claim 1, wherein remaining one of said first and second contact surfaces comprises Au.

3. The electric contact structure as claimed in claim 1, wherein remaining one of said first and second contact surfaces comprises an AuAg alloy.

4. The electric contact structure as claimed in claim 1, wherein a total compositional ratio of Ag and Pd is not less than 14% by weight.

5. The electric contact structure as claimed in claim 4, wherein remaining one of said first and second contact surfaces comprises Au.

6. The electric contact structure as claimed in claim 4, wherein remaining one of said first and second contact surfaces comprises an AuAg alloy.

7. The electric contact structure as claimed in claim 1, wherein at least one of said first and second contact surfaces is formed on an intermediate alloy layer jointed with a contact spring member.

8. The electric contact structure as claimed in claim 7, wherein said intermediate alloy layer comprises an AgNi alloy.

9. The electric contact structure as claimed in claim 7, wherein said intermediate alloy layer comprises an AgPd alloy.

10. The electric contact structure as claimed in claim 1, wherein at least one of said first and second contact surfaces is formed on an intermediate alloy layer formed on a base metal layer jointed with a contact spring member.

11. The electric contact structure as claimed in claim 10, wherein said intermediate alloy layer comprises an AgNi alloy.

12. The electric contact structure as claimed in claim 10, wherein said intermediate alloy layer comprises an AgPd alloy.

13. The electric contact structure as claimed in claim 10, wherein said base metal layer comprises a CuNi alloy.

14. The electric contact structure as claimed in claim 1, wherein said electric contact structure comprises a relay contact.

15. The electric contact structure as claimed in claim 1, wherein said electric contact structure comprises a switch contact.

16. A relay having an electric contact structure of claim 1.

17. A switching device having an electric contact structure of claim 1.

18. An electric contact surface structure comprising an AuAgPd alloy including 7–16% by weight of Ag and 1–10% by weight of Pd.

* * * * *